US009070989B2

(12) United States Patent
Yasui et al.

(10) Patent No.: US 9,070,989 B2
(45) Date of Patent: Jun. 30, 2015

(54) TERMINAL CONNECTION JOINT AND TERMINAL BLOCK

(71) Applicant: NABTESCO CORPORATION, Tokyo (JP)

(72) Inventors: Tsutomu Yasui, Gifu (JP); Shigeo Hokazono, Gifu (JP)

(73) Assignee: NABTESCO CORPORATION (JP)

( * ) Notice: Subject to any disclaimer, the term of this patent is extended or adjusted under 35 U.S.C. 154(b) by 21 days.

(21) Appl. No.: 14/101,844

(22) Filed: Dec. 10, 2013

(65) Prior Publication Data

US 2014/0162486 A1 Jun. 12, 2014

(30) Foreign Application Priority Data

Dec. 11, 2012 (JP) ..... 2012-270206

(51) Int. Cl.

| | |
|---|---|
| ***H01R 4/30*** | (2006.01) |
| ***H01R 9/24*** | (2006.01) |
| ***H01R 4/38*** | (2006.01) |
| ***H01R 11/28*** | (2006.01) |

(52) U.S. Cl.

CPC ..... *H01R 9/2491* (2013.01); *H01R 4/304* (2013.01); *H01R 4/38* (2013.01); *H01R 11/283* (2013.01)

(58) Field of Classification Search

CPC ..... H01R 4/38; H01R 4/30; H01R 4/304; H01R 4/305; H01R 4/308; H01R 4/34; H01R 11/283

See application file for complete search history.

(56) References Cited

U.S. PATENT DOCUMENTS

| | | | | | |
|---|---|---|---|---|---|
| 4,210,379 | A | * | 7/1980 | Vachhani et al. | 439/406 |
| 4,236,778 | A | * | 12/1980 | Hughes et al. | 439/406 |
| 5,454,741 | A | * | 10/1995 | Okada | 439/762 |
| 5,492,780 | A | * | 2/1996 | Okada | 429/121 |
| 5,493,085 | A | * | 2/1996 | Kolberg et al. | 200/51 R |
| 5,713,707 | A | * | 2/1998 | Gagnon | 411/175 |
| 5,805,047 | A | * | 9/1998 | De Villeroche et al. | 337/290 |
| 5,851,129 | A | * | 12/1998 | Matsunaga et al. | 439/764 |
| 5,897,403 | A | * | 4/1999 | Kourimsky | 439/761 |
| 6,174,207 | B1 | * | 1/2001 | Cleveland | 439/773 |
| 6,450,747 | B1 | * | 9/2002 | Fischer | 411/174 |
| 6,884,123 | B2 | * | 4/2005 | Kim | 439/754 |
| 6,933,442 | B2 | * | 8/2005 | Franks, Jr. | 174/51 |

(Continued)

FOREIGN PATENT DOCUMENTS

| | | |
|---|---|---|
| JP | 2007-207494 | 8/2007 |
| JP | 2007311275 | 11/2007 |
| JP | 2010129287 | 6/2010 |

*Primary Examiner* — Ross Gushi

(74) *Attorney, Agent, or Firm* — Gerald E. Hespos; Michael J. Porco; Matthew T. Hespos

(57) ABSTRACT

A terminal block includes a terminal portion having an end surface formed with a screw hole and a peripheral surface, a terminal connection joint including a tubular portion having an inner peripheral surface which faces the peripheral surface of the terminal portion, a contact portion having a first contact surface which comes into contact with the end surface of the terminal portion and a second contact surface which comes into contact with a plate-like terminal and a clamping portion for clamping the plate-like terminal between the contact portion and the clamping portion, a fixing bolt including an externally threaded portion to be threadably engaged with the screw hole and a head portion for pressing the clamping portion in a direction to press the plate-like terminal. The contact portion is configured to press the plate-like terminal by being elastically supported on the tubular portion.

7 Claims, 4 Drawing Sheets

(56) References Cited

U.S. PATENT DOCUMENTS

| | | | | |
|---|---|---|---|---|
| 7,306,475 | B2 * | 12/2007 | Tsuruta | 439/364 |
| 7,878,745 | B2 * | 2/2011 | Allen et al. | 411/175 |
| 8,033,875 | B1 * | 10/2011 | Maguire | 439/762 |
| 2006/0003627 | A1 * | 1/2006 | Freitag | 439/504 |
| 2009/0191454 | A1 * | 7/2009 | Detter et al. | 429/121 |
| 2010/0055994 | A1 | 3/2010 | Mizutani | |
| 2012/0196492 | A1 * | 8/2012 | Facco et al. | 439/765 |
| 2013/0237102 | A1 * | 9/2013 | Hermann et al. | 439/792 |
| 2014/0134895 | A1 * | 5/2014 | Kim | 439/758 |
| 2014/0134896 | A1 * | 5/2014 | Kim | 439/762 |
| 2014/0134897 | A1 * | 5/2014 | Akuta | 439/782 |
| 2014/0162486 | A1 * | 6/2014 | Yasui et al. | 439/359 |
| 2015/0004852 | A1 * | 1/2015 | Hildebrand et al. | 439/810 |
| 2015/0017843 | A1 * | 1/2015 | Seehoffer et al. | 439/815 |

* cited by examiner

TERMINAL CONNECTION JOINT AND TERMINAL BLOCK

BACKGROUND OF THE INVENTION

1. Technical Field

The present invention relates to a terminal connection joint and a terminal block.

2. Background Art

There is conventionally known a terminal block configured such that a terminal is fixed by being clamped between a flange portion formed on a base end part of a contact bolt and a nut threadably engaged with the contact bolt as disclosed in Japanese Unexamined Patent Publication No. 2007-207494.

In a configuration for fixing a terminal by a fastening force of a bolt and a nut (fastening portion) as in the terminal block disclosed in Japanese Unexamined Patent Publication No. 2007-207494, the nut may be gradually loosened by being continuously subjected to vibration, for example, in the case of use in an air plane. Thus, a contact area between the fastening portion and the terminal may possibly decrease to increase an electrical resistance.

SUMMARY OF THE INVENTION

An object of the present invention is to prevent an increase in electrical resistance even if a fastening force of a fastening portion is weakened.

One aspect of the present invention is directed to a terminal block, including a terminal portion having an end surface formed with a screw hole and a peripheral surface, a terminal connection joint including a tubular portion having an inner peripheral surface which faces the peripheral surface of the terminal portion, a contact portion having a first contact surface which comes into contact with the end surface of the terminal portion and a second contact surface which comes into contact with a plate-like terminal and a clamping portion for clamping the plate-like terminal between the contact portion and the clamping portion, and a fastening portion including an externally threaded portion to be threadably engaged with the screw hole and a pressing portion for pressing the clamping portion in a direction to press the plate-like terminal. The contact portion is configured to receive a pressing force by the pressing portion while being elastically supported on the tubular portion.

Another aspect of the present invention is directed to a terminal connection joint for electrically connecting a terminal portion provided on a terminal block and a plate-like terminal, including a tubular portion having an inner peripheral surface which faces a peripheral surface of the terminal portion, a contact portion having a first contact surface which comes into contact with an end surface of the terminal portion and a second contact surface which comes into contact with a plate-like terminal, and a clamping portion for clamping the plate-like terminal between the contact portion and the clamping portion. The contact portion is configured to press the plate-like terminal by being elastically supported on the tubular portion.

These and other objects, features and advantages of the present disclosure will become more apparent upon reading the following detailed description along with the accompanying drawings.

MODE FOR CARRYING OUT THE INVENTION

Hereinafter, a mode for carrying out the present invention is described in detail with reference to the drawings.

Figure 1:
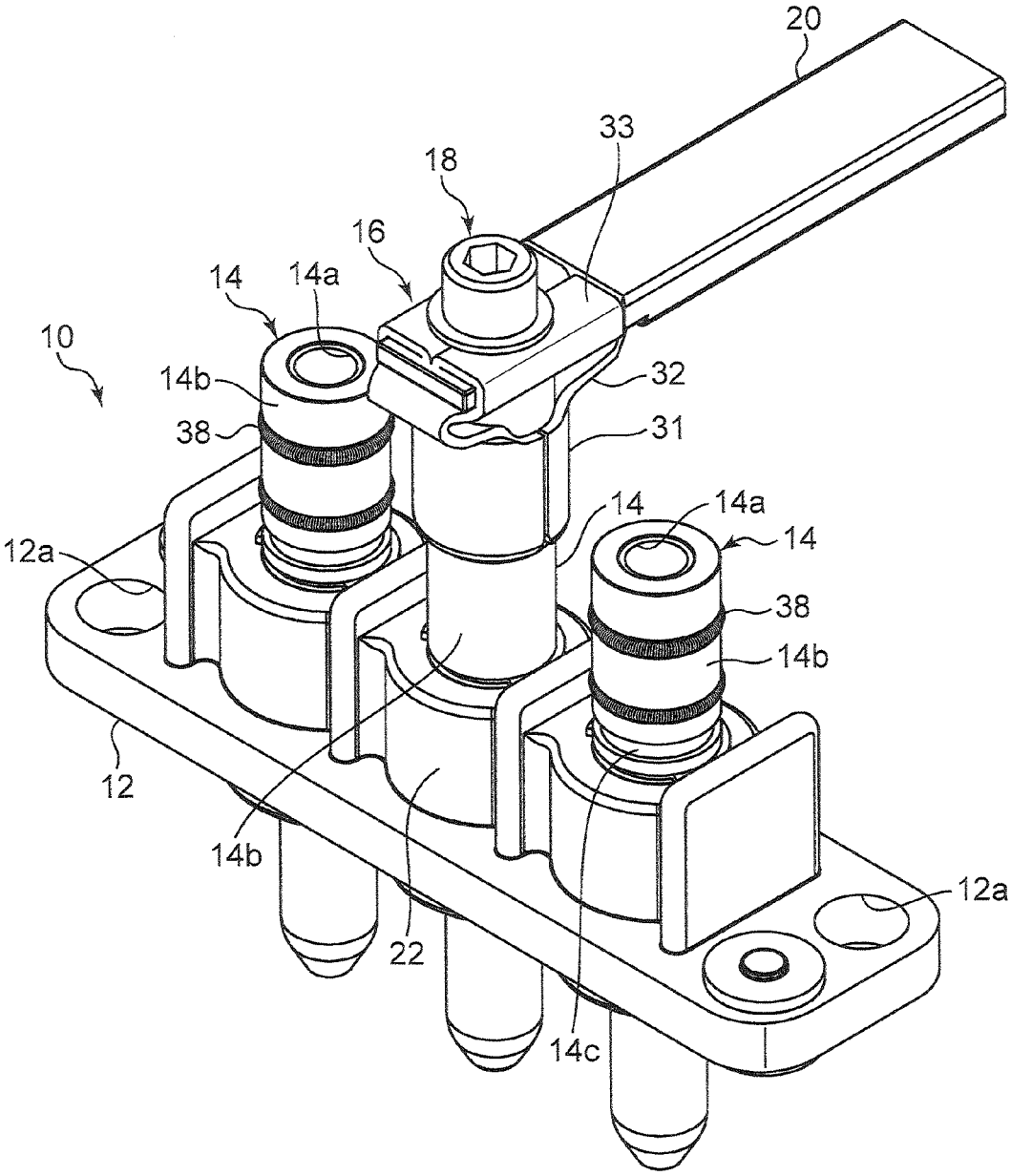
FIG. 1 is a perspective view of a terminal block according to an embodiment of the present invention.

A terminal block 10 according to this embodiment is a terminal block for electrically connecting a control device to be installed in an air plane and a power supply thereof. As shown in FIG. 1, the terminal block 10 includes a base 12, terminal portions 14 fixed to the base 12, a terminal connection joint 16 for attaching a plate-like terminal 20 to the terminal portion 14, and a fixing bolt 18 for fixing the terminal connection joint 16.

The base 12 is in the form of a rectangular flat plate long in one direction. A plurality of terminal portions 14 are juxtaposed in a longitudinal direction of the base 12. The middle terminal portion 14 is formed to be taller than the terminal portions 14 on opposite ends. Insertion holes 12*a*, through which unillustrated bolts for fixing the base 12 to an unillustrated fixing body are inserted, are formed on end parts of the base 12. Note that there is no limitation to the configuration that the middle terminal portion 14 is taller than the terminal portions 14 on the opposite ends.

Each terminal portion 14 is fixed to the base 12 while penetrating through the base 12 in a thickness direction. The terminal portion 14 is formed into a cylindrical shape as a whole and stably supported on the base 12 by being held in a holding portion 22 provided on the base 12. A tip surface (upper end surface) of the terminal portion 14 is formed to be flat and a screw hole 14*a* extending in an axial direction is formed in a central part of the tip surface. This screw hole 14*a* serves as an internal thread. Note that the terminal portion 14 needs not be formed into a cylindrical shape and only has to have a peripheral surface. For example, the terminal portion 14 may be formed into a prismatic shape.

The plate-like terminal 20 is a terminal in the form of a thin and slender flat plate and has flexibility. Either the terminal portions 14 or the plate-like terminal 20 are/is connected to the control device and the other(s) is/are connected to the power supply for the control device.

Figure 2:
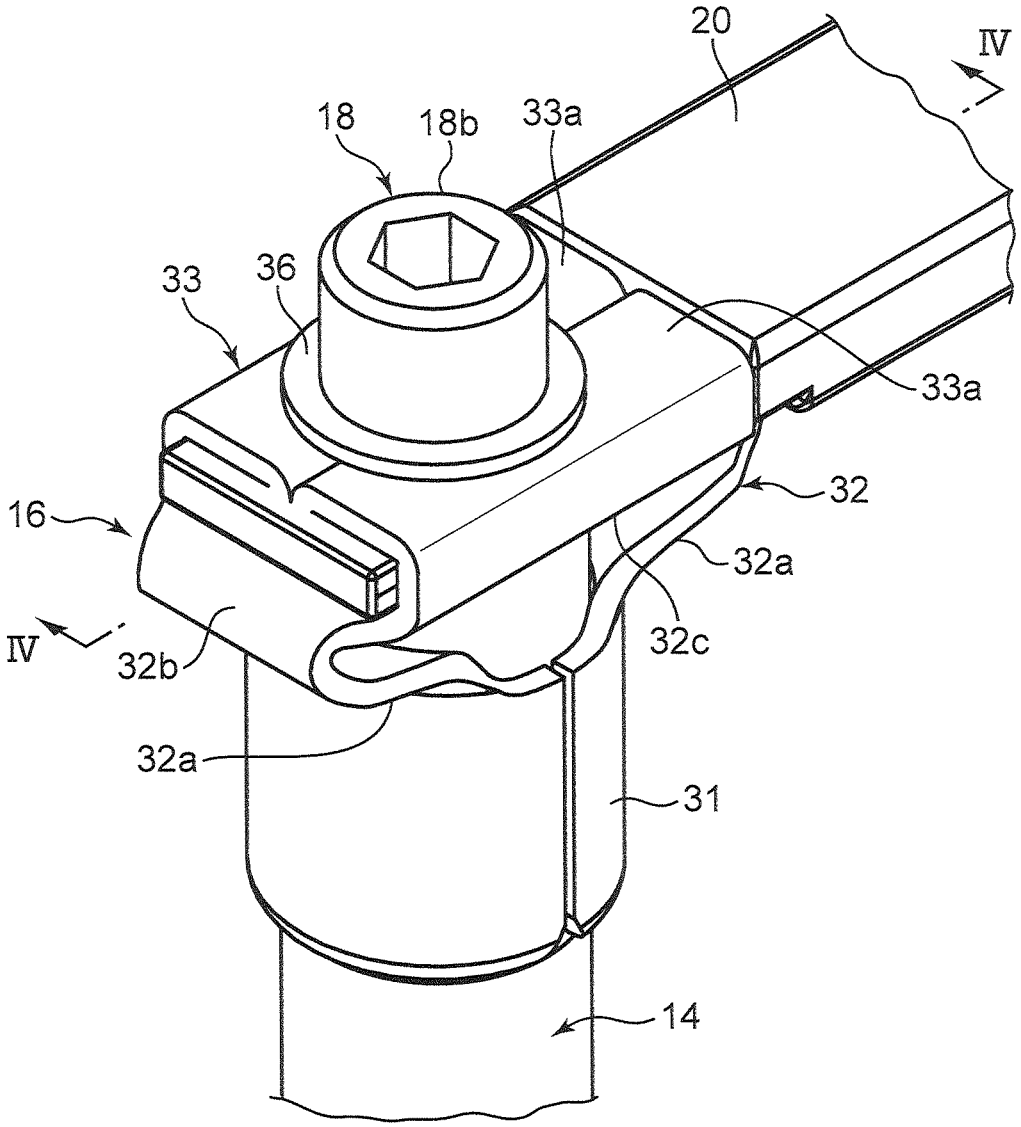
FIG. 2 is a perspective view enlargedly showing a connecting part of a terminal portion and a plate-like terminal in the terminal block.
Figure 3:
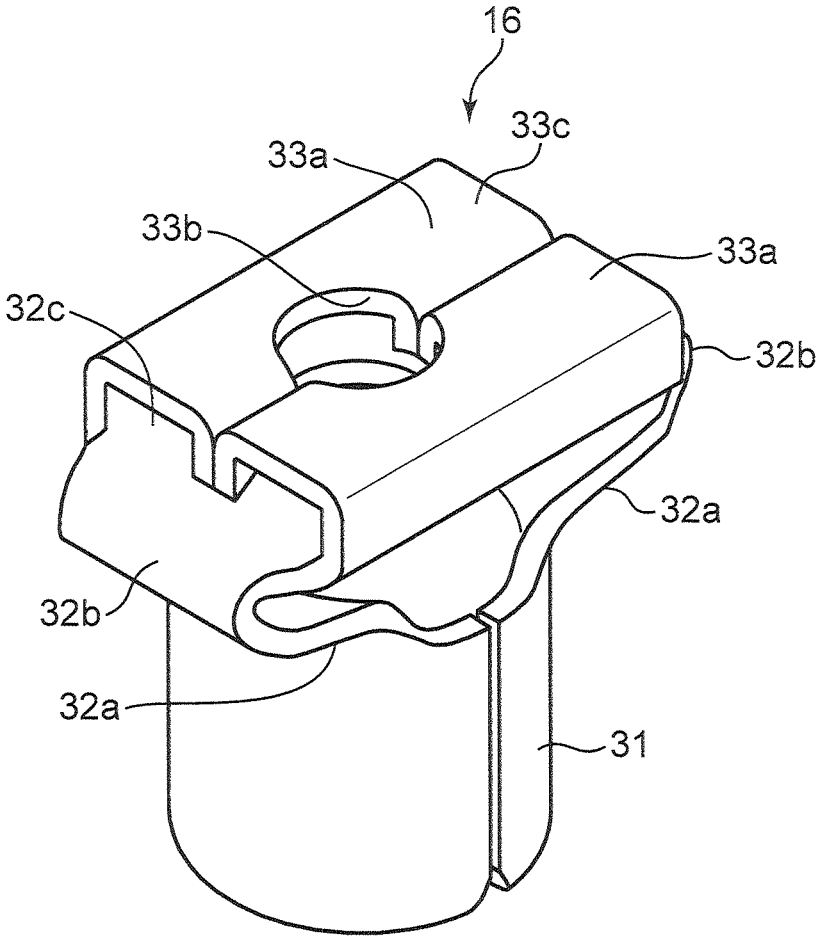
FIG. 3 is a perspective view of a terminal connection joint.
Figure 4:
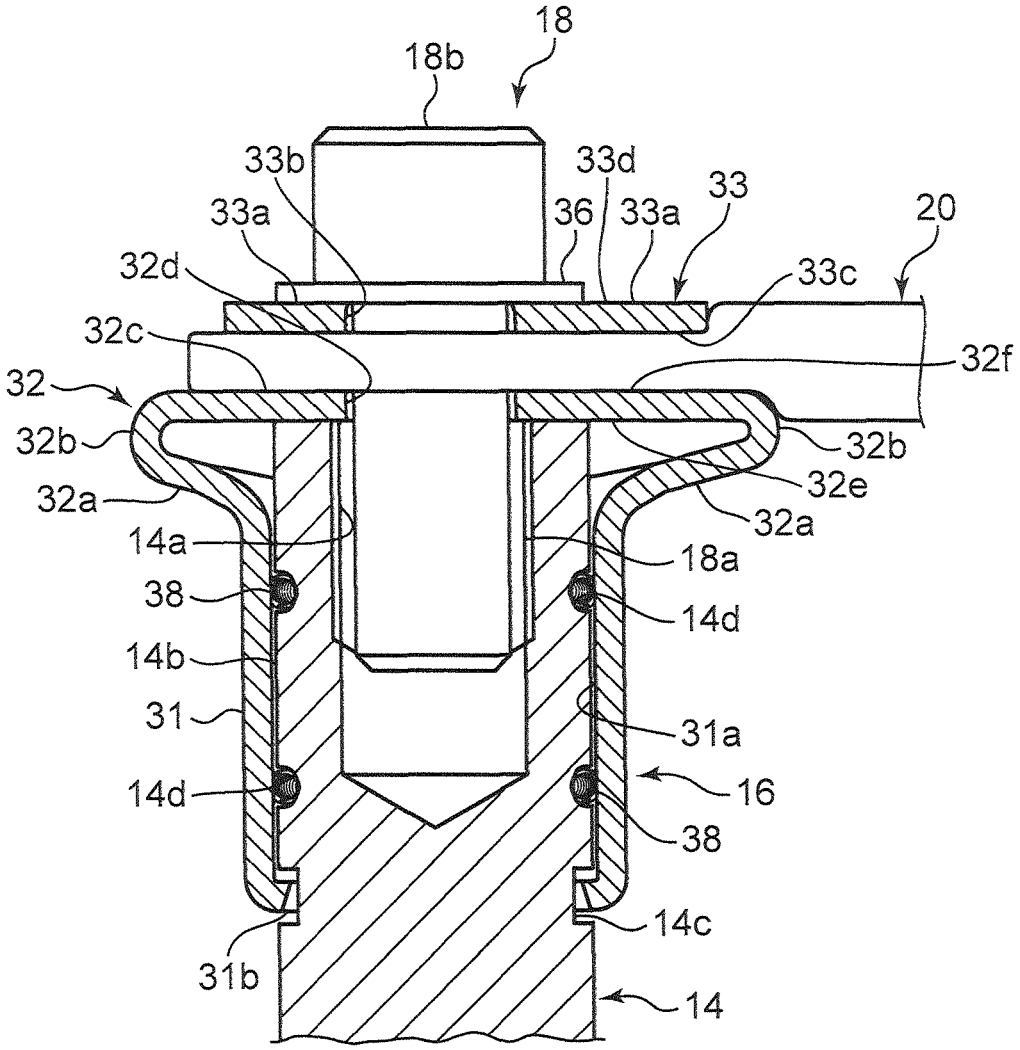
FIG. 4 is a sectional view along line IV-IV of FIG. 2.

As shown in FIGS. 2 to 4, the terminal connection joint 16 includes a tubular portion 31, a receiving portion 32 and a clamping portion 33. The tubular portion 31 is a part which is formed into a cylindrical tubular shape and covers a peripheral surface 14*b* of the cylindrical terminal portion 14 entirely in a circumferential direction. An inner peripheral surface 31*a* of the tubular portion 31 faces the peripheral surface 14*b* of the terminal portion 14. The tubular portion 31 is formed by rolling a plate-like member into a cylindrical tubular shape. In this embodiment, the tubular portion 31 is formed into a cylindrical tubular shape as a whole by causing semicylindrical tubular members respectively connected to the lower ends of a pair of extending portions 32*a* to be described later to face each other. Note that the shape of the tubular portion 31 is not limited to a cylindrical tubular shape and only has to have an inner peripheral surface. For example, if the terminal portion 14 is formed into a prismatic shape, the tubular portion 31 may be formed into a prismatic tubular shape.

The receiving portion 32 is formed by bending parts respectively extending from two parts (semicylindrical tubular parts) facing each other at an end part (upper end part) of the tubular portion 31 in directions toward each other. Specifically, the receiving portion 32 includes a pair of extending portions 32*a*, 32*a* extending obliquely toward opposite sides from the two parts facing each other at the end part of the tubular portion 31, a pair of bent portions 32*b*, 32*b* folded at end parts of the pair of extending portions 32*a*, 32*a* to extend in opposite directions, and a contact portion 32*c* formed into a rectangular planar shape perpendicular to the axial direction (longitudinal direction) of the terminal portion 14 and long in one direction to connect the both bent portions 32*b*, 32*b*. Specifically, the opposite longitudinal ends of the contact portion 32*c* are connected to the tubular portion 31 via the bent portions 32*b* and the extending portions 32*a*.

Since the receiving portion 32 is bent substantially by 180° at the bent portions 32*b*, the contact portion 32*c* thereof receives a bending elastic force of a plate material acting upward in FIG. 4. Specifically, the extending portions 32*a* and the bent portions 32*b* form an elastic supporting portion for elastically supporting the contact portion 32*c*. Thus, the contact portion 32*c* presses the plate-like terminal 20 upward (first direction) by an elastic force.

A projecting portion 31*b* projecting radially inwardly is provided on a lower end part of the tubular portion 31 (end part opposite to the receiving portion 32). The projecting portion 31*b* is formed by bending the lower end part of the tubular portion 31 inwardly. This projecting portion 31*b* is inserted into a recessed groove 14*c* as a recess formed on the peripheral surface 14*b* of the terminal portion 14. Specifically, if the terminal connection joint 16 is moved downward in assembling the terminal connection joint 16 with the terminal portion 14, the projecting portion 31*b* of the tubular portion 31 is fitted into the recessed groove 14*c* of the terminal portion 14, wherefore the terminal connection joint 16 is positioned and fixed to the terminal portion 14.

The clamping portion 33 is formed into a rectangular planar shape parallel to the contact portion 32*c* of the receiving portion 32 and long in the one direction. Specifically, the clamping portion 33 is formed by bending clamping extending portions 33*a* in directions toward each other. The clamping extending portions 33*a* are extending from opposite end parts of the contact portion 32*c* of the receiving portion 32 in a direction (width direction) perpendicular to the longitudinal direction. Since the clamping extending portions 33*a* respectively extending from the opposite sides of the receiving portion 32 are bent in the directions toward each other, tip parts thereof are in contact with each other. Note that although the clamping extending portions 33*a* respectively extend from the opposite end parts of the receiving portion 32 in the width direction and are bent in the shown example, there is no limitation to this. For example, a clamping extending portion 33*a* may extend from one end part of the receiving portion 32 in the width direction and be bent. In this case, the clamping extending portion 33*a* extends while having the same area as the receiving portion 32 and being parallel to the receiving portion 32.

To form the terminal connection joint 16, the clamping extending portions 33*a* extending from the opposite end parts (opposite end parts in the width direction) of a part forming the contact portion 32*c* of the receiving portion 33 are bent upward in FIG. 3 so as to face each other and the bent portions 32*b* and the extending portions 32*a* extending from the opposite end parts (opposite end parts in the longitudinal direction) of the part forming the contact portion 32*c* of the receiving portion 33 are bent downward in FIG. 3. Since the semicylindrical tubular parts are respectively formed on the tips of these extending portions 32*a*, the bent portions 32*b* and the extending portions 32*a* only have to be so bent that the semicylindrical tubular parts face each other to form a tubular shape.

An end part of the plate-like terminal 20 is inserted into a space between the receiving portion 32 and the clamping portion 33 of the terminal connection joint 16. A lower surface (back side surface) 32*e* of the contact portion 32*c* of the receiving portion 32 is in contact with the tip surface of the terminal portion 14 and an upper surface (front side surface) 32*f* of the contact portion 32*c* of the receiving portion 32 is in contact with the plate-like terminal 20. Specifically, the lower surface 32*e* of the contact portion 32*c* of the receiving portion 32 serves as a first contact surface which comes into contact with the tip surface of the terminal portion 14 and the upper surface 32*f* of the contact portion 32*c* of the receiving portion 32 serves as a second contact surface which comes into contact with the plate-like terminal 20.

A lower surface (back side surface) 33*c* of the clamping portion 33 serves as a contact surface which comes into contact with the plate-like terminal 20 and an upper surface (front side surface) 33*d* of the clamping portion 33 serves as a pressed surface to be pressed by a head portion 18*b* of the fixing bolt 18 via a washer 36.

Since the clamping portion 33 is pressed from above by the fixing bolt 18, the lower surface 33*c* of the clamping portion 33 presses the plate-like terminal 20 downward (second direction opposite to the first direction). The receiving portion 32 receives a pressing force by the clamping portion 33 via the plate-like terminal 20.

An insertion hole 32*d* (see FIG. 4), through which an externally threaded portion 18*a* of the fixing bolt 18 is inserted, is formed in a central part of the receiving portion 32. Further, an insertion hole 33*b* (see FIG. 4), through which the externally threaded portion 18*a* of the fixing bolt 18 is inserted, is formed in a central part of the clamping portion 33.

The terminal connection joint 16 is formed of one plate material. Specifically, opposite end parts (first parts) of the plate material are respectively bent into a semicylindrical tubular shape. Then, a part (second part) connected to base end parts of the first parts of the plate material is so bent that concave surfaces of these semicylindrical tubular shapes face each other to form the receiving portion 32, whereby a cylindrical tubular part is formed by the semicylindrical tubular parts. In this way, the tubular portion 31 is formed. Then, parts (third parts) extending from the opposite sides of the receiving portion 32 in the width direction are bent to form the clamping portion 33. In this way, the terminal connection joint 16 can be formed of one plate material.

As shown in FIG. 4, a ring-shaped coil spring 38 is interposed between the inner peripheral surface 31*a* of the tubular portion 31 and the terminal portion 14. Specifically, a circumferentially extending groove 14*d* is formed on the peripheral surface 14*b* of the terminal portion 14 entirely in the circumferential direction, and the coil spring 38 is arranged in this groove 14*d*. Although FIG. 4 shows an example in which the tubular portion 31 and the terminal portion 14 are in contact via the coil spring 38 and the tubular portion 31 and the terminal portion 14 are not directly in contact, the tubular portion 31 and the terminal portion 14 may be directly in contact instead of this. It is made difficult for the tubular portion 31 to move relative to the terminal portion 14 by arranging the coil spring 38 between the tubular portion 31 and the terminal portion 14.

The fixing bolt 18 functions as a fastening portion including the externally threaded portion 18*a* to be threadably engaged with the screw hole 14*a* and the head portion 18*b* as a pressing portion formed on an end part of the externally threaded portion 18*a*. The head portion 18*b* presses the clamping portion 33 in a direction to press the plate-like terminal 20 via the washer 36. As the fixing bolt 18 is screwed into the screw hole 14*a* of the terminal portion 14, the head portion 18*b* of the fixing bolt 18 presses the clamping portion 33 from above via the washer 36, whereby the plate-like terminal 20 presses the contact portion 32*c* of the receiving portion 32 from above. Thus, the contact portion 32*c* is displaced downward while the bent portions 32*b* and the extending portions 32*a* are elastically deformed, and the contact portion 32*c* comes into contact with the tip surface of the terminal portion 14. Specifically, the contact portion 32*c* is supported in a state where the bent portions 32*b* and the extending portions 32*a* are elastically deformed. Thus, the plate-like terminal 20 receives an elastic force by the contact portion 32*c* from below while receiving a fastening force by the fixing bolt 18 from above.

As described above, in this embodiment, the externally threaded portion 18*a* of the fixing bolt 18 is threadably engaged with the screw hole 14*a* of the terminal portion 14, whereby the clamping portion 33 of the terminal connection joint 16 can be pressed by the head portion 18*b* of the fixing bolt 18. This causes the clamping portion 33 to press one surface (upper surface in FIG. 4) of the plate-like terminal 20. Further, the contact portion 32*c* of the terminal connection joint 16 is elastically supported on the tubular portion 31 to press another surface (lower surface in FIG. 4) of the plate-like terminal 20. In this way, a contact between the terminal connection joint 16 and the terminal portion 14 is ensured by the fastening force by the screw and the elastic force for supporting the contact portion 32*c*. In addition, since the plate-like terminal 20 is pressed by the elastic force from the side opposite to the fastening force by the screw, even if the fastening force of the screw is weakened due to continuous subjection to vibration, the contact between the clamping portion 33 and the plate-like terminal 20 and the contact between the contact portion 32*c* and the plate-like terminal 20 are ensured by the elastic force. Thus, the electrical resistance is not increased due to a reduction in the contact area and heat generation due to an increase in the electrical resistance can be prevented.

Further, since the projecting portion 31*b* of the tubular portion 31 is inserted into the recessed groove 14*c* of the terminal portion 14 in this embodiment, the terminal connection joint 16 is locked to the terminal portion 14. Thus, the terminal connection joint 16 does not axially move relative to the terminal portion 14, wherefore the detachment of the terminal connection joint 16 can be prevented.

Further, since the coil spring 38 is interposed between the tubular portion 31 and the terminal portion 14 in this embodiment, it is made difficult for the terminal connection joint 16 to move relative to the terminal portion 14. Thus, the terminal connection joint 16 can be stably held.

Further, since the terminal connection joint 16 is formed of one plate material in this embodiment, an increase in the number of components constituting the terminal block 10 can be suppressed and, in addition, an assembling operation of the terminal block 10 can be simplified.

Note that the present invention is not limited to the above embodiment and various changes, improvements and the like can be made without departing from the gist thereof. For example, although the terminal connection joint 16 is formed of one plate material in the above embodiment, there is no limitation to this. The terminal connection joint 16 may be formed by separately forming a tubular portion 31, a contact portion 32*c* and an elastic supporting portion for elastically supporting the contact portion 32*c* and then assembling them with each other.

Although the fixing bolt 18 includes the externally threaded portion 18*a* and the head portion 18*b* in the above embodiment, there is no limitation to this. The fastening portion may include the externally threaded portion 18*a* and a nut to be threadably engaged with this externally threaded portion 18*a*. In this configuration, the nut presses the clamping portion 33 via the washer 36 by being tightened. Note that the washer 36 may be omitted.

Here, the above embodiment is summarized.

(1) In the above embodiment, the externally threaded portion of the fastening portion is threadably engaged with the screw hole of the terminal portion, whereby the clamping portion of the terminal connection joint can be pressed by the pressing portion of the fastening portion. This causes the clamping portion to press one surface of the plate-like terminal. Further, the contact portion of the terminal connection joint is elastically supported on the tubular portion having the inner peripheral surface facing the peripheral surface of the terminal portion, and the other surface of the plate-like terminal is pressed. In this way, the contact between the terminal connection joint and the terminal portion is ensured by the fastening force by the screw and the elastic force for supporting the contact portion. In addition, since the plate-like terminal is pressed by the elastic force from the side opposite to the fastening force by the screw, even if the fastening force of the screw is weakened due to continuous subjection to vibration, the contact between the clamping portion and the plate-like terminal and the contact between the contact portion and the plate-like terminal are ensured by the elastic force. Thus, the electrical resistance is not increased due to a reduction in the contact area and heat generation due to an increase in the electrical resistance can be prevented.

(2) In the above terminal block, the projecting portion may be formed on the end part of the tubular portion opposite to the contact portion by being bent toward an inner peripheral surface side. In this case, the projecting portion may be inserted into the recess formed on the peripheral surface of the terminal portion.

Since the projecting portion is inserted in the recess in this mode, the terminal connection joint is locked to the terminal portion. Thus, the terminal connection joint does not axially move relative to the terminal portion, wherefore the detachment of the terminal connection joint can be prevented.

(3) The ring-shaped coil spring may be interposed between the tubular portion and the terminal portion.

In this mode, the coil spring is interposed between the tubular portion and the terminal portion, thereby making it difficult for the terminal connection joint to move relative to the terminal portion. Thus, the terminal connection joint can be stably held.

(4) The terminal connection joint may be formed of one plate material.

In this mode, an increase in the number of components constituting the terminal block can be suppressed and, in addition, the assembling operation of the terminal block can be simplified.

(5) In the above embodiment, the terminal connection joint for electrically connecting the terminal portion provided on the terminal block and the plate-like terminal includes the tubular portion having the inner peripheral surface that faces the peripheral surface of the terminal portion, the contact portion having the first contact surface that comes into contact with the end surface of the terminal portion and the second contact surface that comes into contact with the plate-like terminal, and the clamping portion for clamping the plate-like terminal between the contact portion and the clamping portion. The contact portion is configured to press the plate-like terminal by being elastically supported on the tubular portion.

(6) In the terminal connection joint, the projecting portion may be formed on the end part of the tubular portion opposite to the contact portion by being bent toward the inner peripheral surface side.

(7) The terminal connection joint may be formed of one plate material.

As described above, according to this embodiment, even if the fastening force of the fastening portion is weakened, an increase in electrical resistance can be prevented.

This application is based on Japanese Patent application No. 2012-270206 filed in Japan Patent Office on Dec. 11, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A terminal block, comprising:

a terminal portion having an end surface formed with a screw hole and a peripheral surface;

a terminal connection joint including a tubular portion having an inner peripheral surface which faces the peripheral surface of the terminal portion, a contact portion having a first contact surface which comes into contact with the end surface of the terminal portion and a second contact surface which comes into contact with a plate-like terminal and a clamping portion for clamping the plate-like terminal between the contact portion and the clamping portion; and a fastening portion including an externally threaded portion to be threadably engaged with the screw hole and a pressing portion for pressing the clamping portion in a direction to press the plate-like terminal;

the contact portion being configured to receive a pressing force by the pressing portion while being elastically supported on the tubular portion.

2. A terminal block according to claim 1, wherein:

a projecting portion is formed on an end part of the tubular portion opposite to the contact portion by being bent toward an inner peripheral surface side; and the projecting portion is inserted into a recess formed on the peripheral surface of the terminal portion.

3. A terminal block according to claim 1, wherein:

a ring-shaped coil spring is interposed between the tubular portion and the terminal portion.

4. A terminal block according to claim 1, wherein:

the terminal connection joint is formed of one plate material.

5. A terminal connection joint for electrically connecting a terminal portion provided on a terminal block and a plate-like terminal, comprising:

a tubular portion having an inner peripheral surface which faces a peripheral surface of the terminal portion;

a contact portion having a first contact surface which comes into contact with an end surface of the terminal portion and a second contact surface which comes into contact with the plate-like terminal; and a clamping portion for clamping the plate-like terminal between the contact portion and the clamping portion;

the contact portion being configured to press the plate-like terminal by being elastically supported on the tubular portion.

6. A terminal connection joint according to claim 5, wherein:

a projecting portion is formed on an end part of the tubular portion opposite to the contact portion by being bent toward an inner peripheral surface side.

7. A terminal connection joint according to claim 5, wherein:

the terminal connection joint is formed of one plate material.

* * * * *